US008733836B2

(12) United States Patent
Gross

(10) Patent No.: US 8,733,836 B2
(45) Date of Patent: May 27, 2014

(54) APPARATUS FOR CONTROLLING TENSION OF ELONGATE STRAP USED IN STRAP FURNITURE

(71) Applicant: Jan S. Gross, Sarasota, FL (US)

(72) Inventor: Jan S. Gross, Sarasota, FL (US)

( * ) Notice: Subject to any disclaimer, the term of this patent is extended or adjusted under 35 U.S.C. 154(b) by 0 days.

(21) Appl. No.: 14/067,463

(22) Filed: Oct. 30, 2013

(65) Prior Publication Data

US 2014/0049091 A1 Feb. 20, 2014

Related U.S. Application Data

(63) Continuation-in-part of application No. 13/186,898, filed on Jul. 20, 2011.

(51) Int. Cl.
*A47C 31/00* (2006.01)

(52) U.S. Cl.
USPC ..... 297/228.12; 297/452.63; 297/31; 297/229; 297/452.56

(58) Field of Classification Search
USPC ..... 297/228.13, 204, 228.12, 229, 219.1, 297/452.63, 31, 452.56; 24/170, 191, 193
See application file for complete search history.

(56) References Cited

U.S. PATENT DOCUMENTS

| | | | | |
|---|---|---|---|---|
| 1,664,103 | A | 3/1928 | Bishoff | |
| 1,912,282 | A * | 5/1933 | Krebs | 297/284.2 |
| 3,083,054 | A * | 3/1963 | Weaver | 297/228.12 |
| 4,567,628 | A * | 2/1986 | Prete, Jr. et al. | 24/68 CD |
| 5,005,527 | A * | 4/1991 | Hatfield | 119/793 |
| 5,187,839 | A * | 2/1993 | Collins | 24/170 |
| 5,205,021 | A * | 4/1993 | Durand | 24/163 R |
| 5,275,463 | A * | 1/1994 | Rocha | 297/229 |
| 5,735,578 | A | 4/1998 | Penley | |
| 5,803,539 | A * | 9/1998 | Dewar et al. | 297/228.12 |
| 5,920,963 | A * | 7/1999 | Chou | 24/170 |
| 6,089,659 | A * | 7/2000 | Toyota | 297/228.11 |
| 6,099,021 | A | 8/2000 | Benoit | |
| 6,338,527 | B1 * | 1/2002 | Toyota et al. | 297/229 |
| 6,868,587 | B2 * | 3/2005 | Rard | 24/170 |
| 6,951,367 | B1 * | 10/2005 | Dinnan | 297/228.12 |
| 7,121,122 | B2 * | 10/2006 | Levi | 70/18 |
| 7,334,301 | B2 * | 2/2008 | Huang | 24/170 |
| 7,712,191 | B2 * | 5/2010 | Huang | 24/68 CD |
| 8,522,402 | B1 * | 9/2013 | Spooler | 24/69 CT |
| 2002/0021034 | A1 * | 2/2002 | Morgan et al. | 297/228.12 |
| 2002/0093232 | A1 * | 7/2002 | Toyota et al. | 297/229 |
| 2003/0172499 | A1 * | 9/2003 | Uehara et al. | 24/170 |
| 2004/0187271 | A1 * | 9/2004 | Mikkelsen | 24/170 |
| 2007/0226961 | A1 * | 10/2007 | Anderson et al. | 24/170 |
| 2008/0010786 | A1 * | 1/2008 | Huang | 24/170 |
| 2008/0148529 | A1 * | 6/2008 | Huang | 24/170 |
| 2008/0281701 | A1 * | 11/2008 | Scheiner | 705/14 |
| 2010/0001565 | A1 * | 1/2010 | Gray et al. | 297/229 |
| 2012/0242126 | A1 * | 9/2012 | Burns | 297/228.12 |

* cited by examiner

*Primary Examiner* — David R Dunn
*Assistant Examiner* — Alexander Harrison
(74) *Attorney, Agent, or Firm* — Ronald E. Smith; Smith & Hopen, P.A.

(57) ABSTRACT

A strap-tightening structure for a furniture item having a frame that supports an elongate strap. The elongate strap includes a rearward section that overlies the back rest of the furniture and a forward section that overlies the seat section. A rearward end of the elongate strap overlies a transversely disposed rearward end of the frame and is secured against longitudinal displacement when the forward end of the elongate strap is pulled taut at the forward end of the furniture. A pair of tensioning belts are secured to a forward end of the elongate strap. Each of the tensioning belts is disposed in overlying relation to a transversely disposed forward end of the frame. A pair of releasable buckles is secured to a bottom side of the elongate strap and adjustably engages the tensioning belts so that the elongate strap can be pulled taut whenever it develops a sag.

10 Claims, 5 Drawing Sheets

APPARATUS FOR CONTROLLING TENSION OF ELONGATE STRAP USED IN STRAP FURNITURE

BACKGROUND OF THE INVENTION

1. Field of the Invention

This invention relates, generally, to furniture. More particularly, it relates to furniture items such as chairs and chaise lounges having a frame that supports a large plurality of transversely disposed straps typically formed of vinyl and an elongate, longitudinally extending strap, preferably formed of fabric, that extends substantially the entire length of the furniture.

2. Description of the Prior Art

Chairs and chaise lounges having aluminum frames or frames of other suitable materials are often made with an elongate, longitudinally-extending fabric strap supported by the frame and by a plurality of vinyl transverse straps that are also connected to the frame. Over time, the elongate strap can sag and become uncomfortable. The most common prior art solution to the sagging strap problem is to replace the old elongate strap with a new one.

The present inventor has developed a number of ways of taking up the slack as needed. However, those methods require the addition of a transversely disposed tension bar to the frame. Although the tension bar can be provided as original equipment by furniture manufacturers, and although the tension bar can be retrofit onto existing furniture, the ideal solution to the problem would require no tensioning bar.

However, in view of the art considered as a whole at the time the present invention was made, it was not obvious to those of ordinary skill in the art how the elongate strap could be tensioned if the tensioning bar were eliminated.

SUMMARY OF THE INVENTION

The long-standing but heretofore unfulfilled need for an improved apparatus for controlling the tension of an elongate strap of the type used in strap furniture is now met by a new, useful, and non-obvious invention.

The novel elongate strap tension-controlling structure for a furniture item having a frame that supports an elongate strap includes a plurality of conventional transversely disposed straps supported by the conventional frame of the furniture. The plurality of transversely disposed straps extend from a rearward, back rest section of the furniture to a forward, seat or foot section of the furniture, each transverse strap being closely spaced apart from its adjacent transverse strap or straps in a well-known way.

The elongate strap includes a back section that overlies most of the rearward section of the furniture and a forward section that overlies most of the forward section of the furniture. In a preferred embodiment, at least two of the conventional transversely disposed straps are disposed in overlying relation to the elongate strap at the rearward section and at least two of the conventional transversely disposed straps are disposed in overlying relation to the elongate strap at the forward section.

A fastening means secures the rearward or head end of the elongate strap against longitudinal displacement when the rearward end is pulled taut at the forward or foot section of the furniture.

A pair of laterally spaced apart, longitudinally extending tensioning belts is secured to the forward end of the elongate strap. Each of the tensioning belts is disposed in wrapping relation to a transversely disposed forward end of the frame.

A pair of releasable buckles is secured to a bottom side of the elongate strap near the forward end of the elongate strap. A first end of each tensioning belt is secured to the forward end of the elongate strap and to its associated buckle. A second, free end of each tension belt wraps around the transversely disposed forward end of the frame and is adjustably engaged to its associated buckle so that the effective length of each tensioning belt is adjustable in a well-known way.

The releasable buckles are opened to enable the tensioning belts and hence the elongate strap to be pulled taut and they are closed when the elongate strap is pulled taut. The elongate strap may be pulled so taut that the conventional transverse straps are no longer weight-supporting and the elongate strap provides a rather hard surface. However, it is unlikely that a typical user would desire to pull the elongate strap to such a high degree of tautness.

An important object of the invention is to advance the art of strap furniture by enabling a sagging strap to be pulled taut and re-tightened without the use of tools.

Another important object is to provide a novel elongate strap that can be used with conventional furniture of the strap type so that the novel elongate strap can be retrofit onto conventional furniture without requiring structural modification of the conventional furniture.

Another important object is to provide the novel strap with conventional buckles so that no training is required to tighten or loosen the novel elongate strap.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
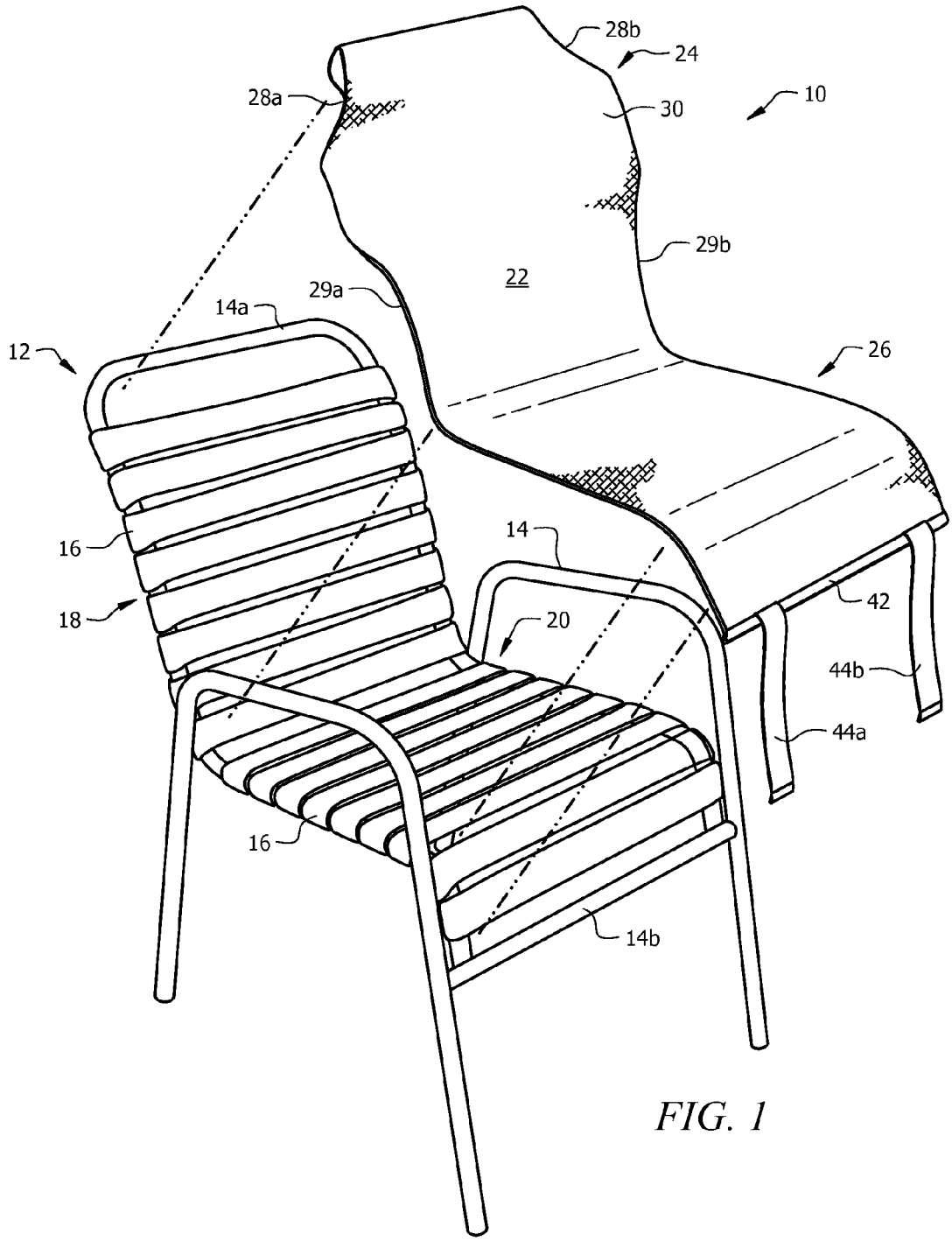
FIG. 1 is an exploded perspective view depicting a chair and the novel structure.

FIG. 1 depicts an illustrative embodiment of the novel structure and a chair of the type with which it is used, both of which are denoted as a whole by the reference numeral 10.

Chair 12 includes tubular frame 14 which is formed of aluminum or other suitable material and a plurality of conventional, transversely disposed straps, collectively denoted 16. Transverse straps 16 are typically formed of vinyl. In some chairs, each strap 16 forms a continuous loop and in other chairs, each strap 16 engages frame 14 at the opposite ends of each strap. Chair 12 includes a back rest or rearward section 18 and a seat or forward section 20.

Novel elongate strap 22 is preferably formed of a fabric and includes a back or rearward section 24 that overlies back rest 18 and a seat or forward section 26 that overlies seat 20 when elongate strap 22 is secured to chair 12.

There are multiple ways to secure elongate strap 22 to chair 12, but in a preferred embodiment, at least two of said transversely disposed straps 16 are disposed in overlying relation to said elongate strap at the rearward section and at least two of said transversely disposed straps are disposed in overlying relation to said elongate strap at the forward section.

More particularly, said at least two of said transversely disposed straps are disposed in overlying relation to the rearward section of elongate strap 22, including a first transversely disposed strap disposed near a rearward end of said rearward section and a second transversely disposed strap disposed near a forward end of said rearward section. Said at least two of said transversely disposed straps disposed in overlying relation to said forward section of said elongate strap include a first transversely disposed strap disposed near a rearward end of said forward section and a second transversely disposed strap disposed near a forward end of said forward section.

Even more particularly, the first required transverse strap that underlies elongate strap 22 is the $5^{th}$ or $6^{th}$ strap from the top of rearward/head section 18 of the chair or chaise. This inhibits movement of elongate strap 22 when a user is seated, locking elongate strap 22 tightly between that transverse strap and frame 14, making displacement of elongate strap 22 almost impossible.

The second required strap that underlies elongate strap 22 is the last, most forward strap of rearward/head section 18.

The third required strap that underlies elongate strap 22 is the first, most rearward strap of forward/foot section 26. This keeps elongate strap 22 firmly in place when head section 18 is repeatedly raised and lowered by a user.

The fourth required strap that underlies elongate strap is the last, most forward strap of forward/foot section 26. This positions a pair of tensioning belts, disclosed hereinafter, at the forward end of elongate strap 22 so that said belts can wrap around the most forward transverse frame member for adjustable connection to buckles secured to an underside of said elongate strap 22 as also disclosed hereinafter.

Figure 2:
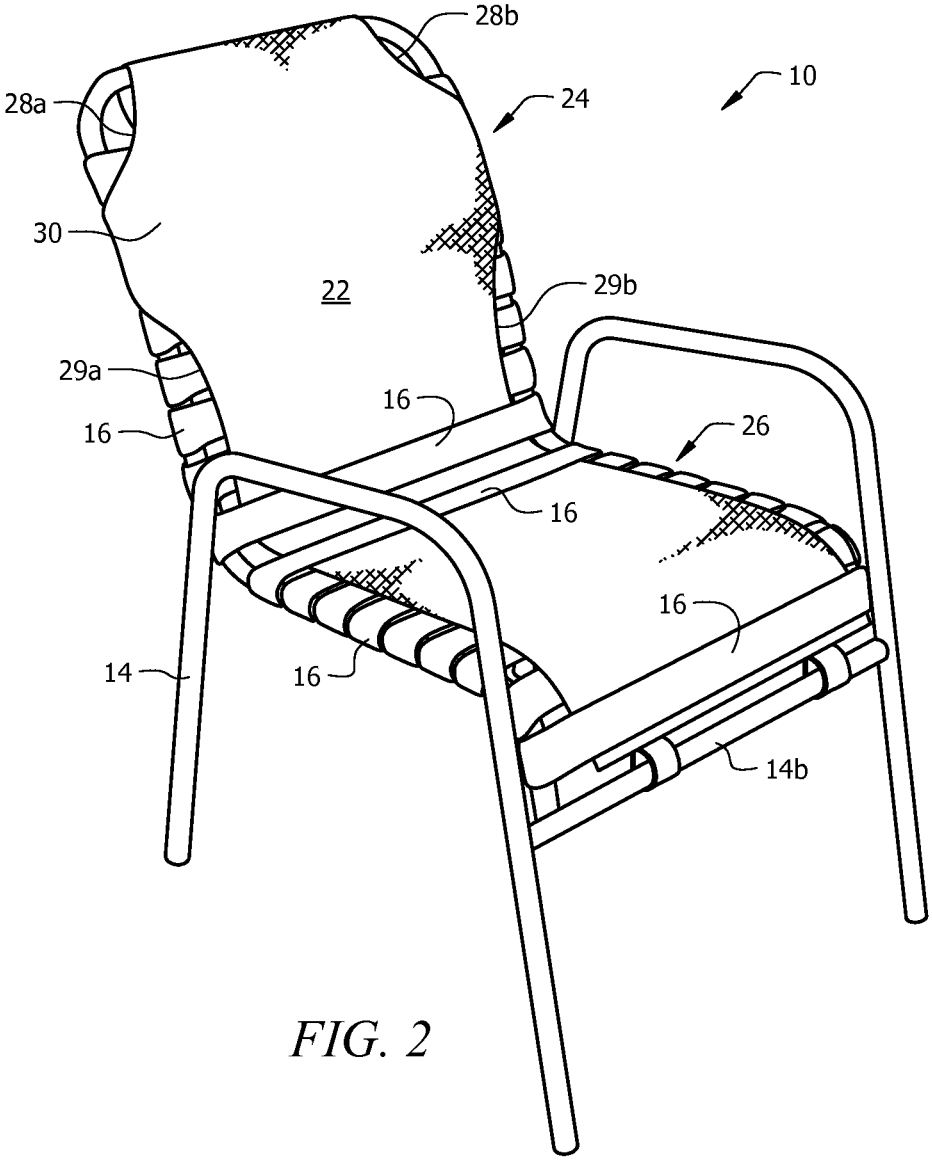
FIG. 2 is a perspective view depicting the novel structure secured to the chair of FIG. 1.
Figure 3:
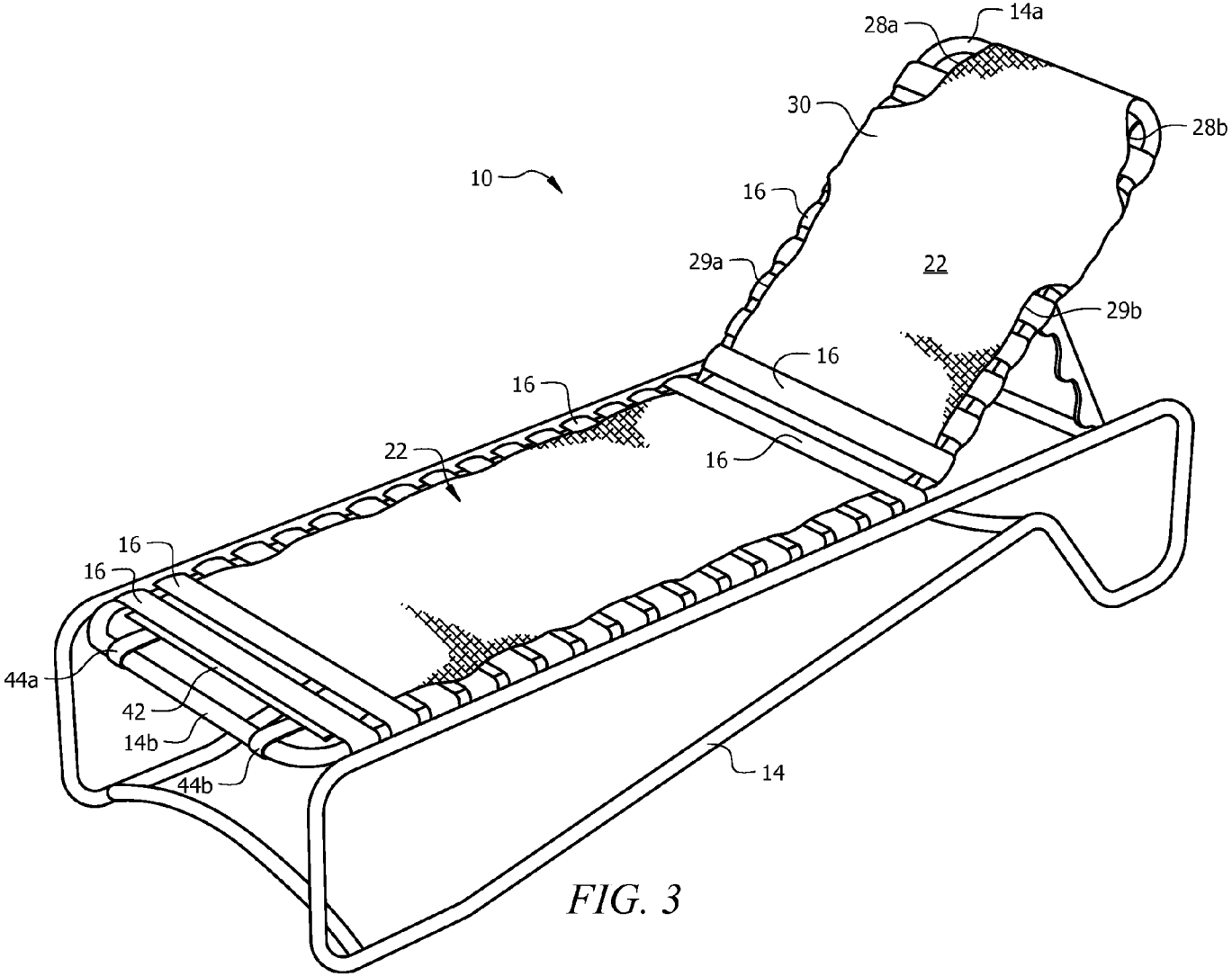
FIG. 3 is a perspective view depicting the novel structure secured to a chaise lounge.

FIG. 3 differs from the FIG. 2 embodiment only because novel elongate strap 22 underlies the ultimate and penultimate transverse straps 16 at the forward end of chair 12.

As depicted in FIG. 1-3, back section 24 of elongate strap 22 is sculpted at its upper left and right corners as at 28*a*, 28*b* and the lower part of back section 24 is also sculpted as at 29*a*, 29*b* so that it shares a common width with that of seat section 26. The medial region 30 of the rearward section of strap 22 thus has a greater width than the sculpted sections above and below it.

Sculpted corners 28*a*, 28*b* are advantageous because they enable elongate strap 22 to be used with chairs or chaises of differing sizes. In the absence of such sculpting, the material of elongate strap 22 would become bunched and unsightly on smaller, i.e., narrower chairs or chaises.

Figure 4:
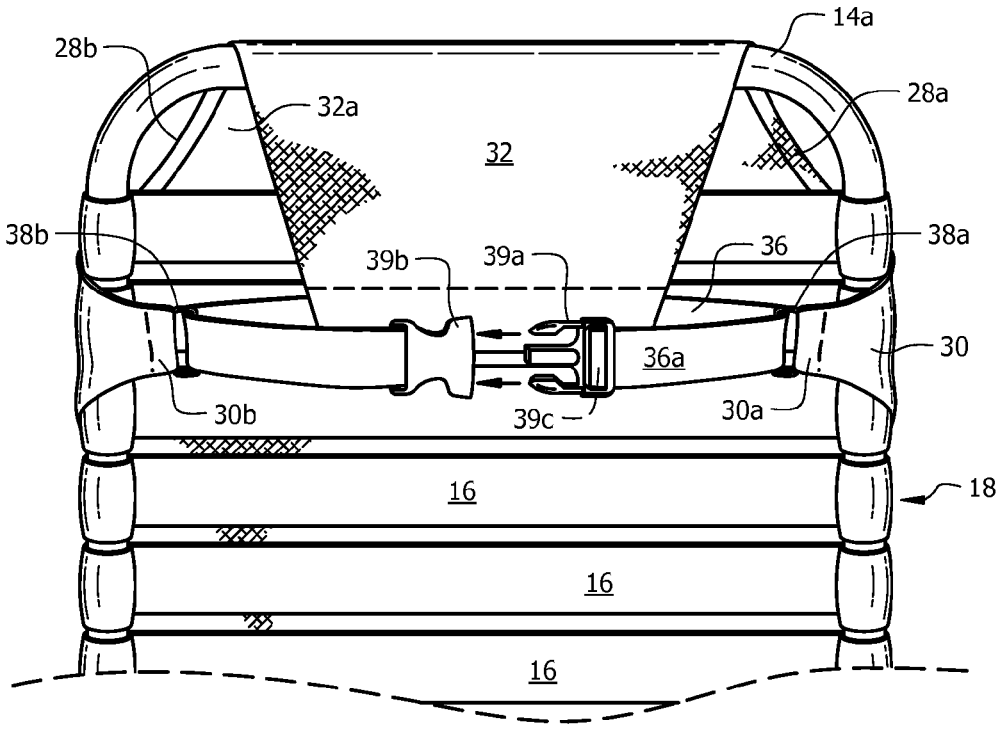
FIG. 4 is a partially cut, rear elevational view depicting the rear of a chair or chaise lounge depicting how the head end of the novel strap is releasably secured to the head end of a chair or chaise lounge.

The uppermost end of elongate strap 22 is denoted 32 in FIG. 4. It wraps over transversely disposed uppermost end 14*a* of frame 14. A transversely disposed pocket 34 is formed at its free end by sewing or other suitable means and retaining belt 36 is slidingly received within said pocket as depicted in said FIG. 4.

Medial region 30 of elongate strap 22 wraps around longitudinally disposed sections of frame 14 that form back rest section 18 and its opposite ends 30*a*, 30*b* are also sewn or otherwise formed into loops as depicted. Those loops capture outboard ends of metal loops 38*a*, 38*b* and the inboard ends of those loops slidingly capture the opposite ends of retaining belt 36. Opposite ends 36*a*, 36*b* of retaining belt 36 are provided with suitable conventional quick release fasteners 39*a*, 39*b*. The effective length of retaining belt 36 is adjusted as needed in a well-known way by pulling end 36*a* around vertical post 39*c*, covered in FIG. 4 by retaining belt 36*a*, if retaining belt 36 is too long and by reversing that procedure if the effective length of said retaining belt 36 needs to be increased. When retaining belt 36 is taut, the uppermost end 32 of elongate strap 22 is also tautly wrapped in its FIG. 4 position.

A non-slip material is secured to the underside of elongate strap 22 in the region of uppermost end 32 as at 32*a* to prevent relative motion between elongate strap 22 and frame section 14*a*.

Figure 5:
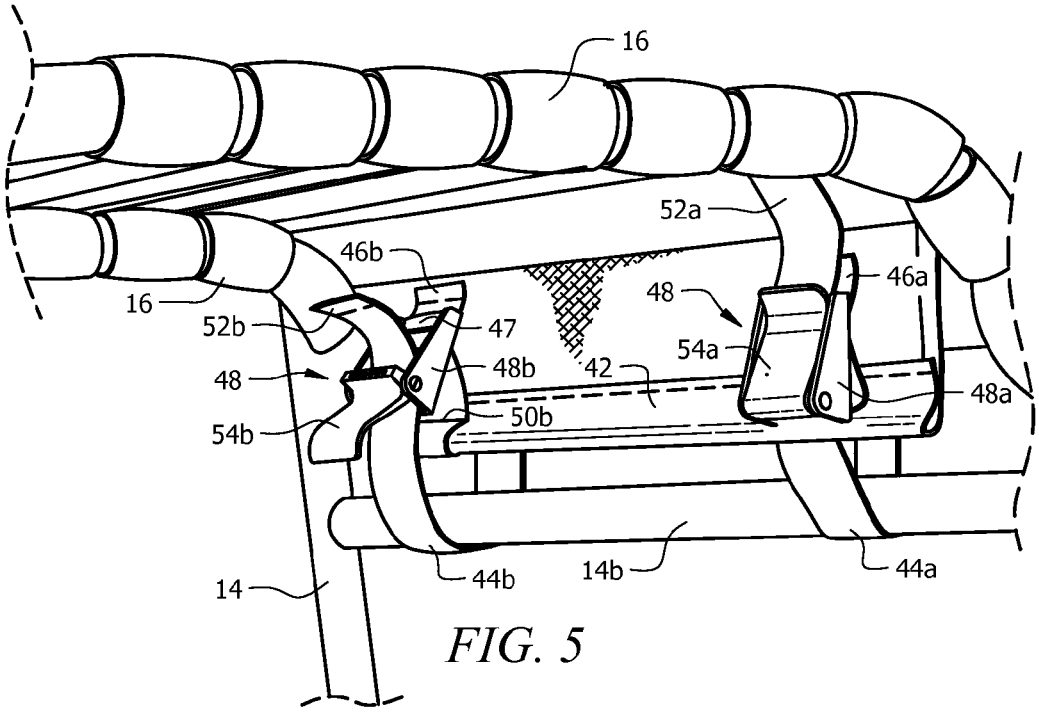
FIG. 5 is a is a cut, perspective view of the underside of the foot end of a chair or chaise lounge depicting how the foot end of the novel strap is releasably secured to the forward end of the frame of a chair or chaise lounge.

When uppermost end 32 of elongate strap 22 is taut, elongate strap 22 as a whole may now be placed into its operable position as depicted in FIG. 2 or 3 and the forward or foot end of said elongate strap may be wrapped around and secured to the forwardmost transversely disposed part of frame 14 as depicted in FIG. 5, said part being denoted 14*b*.

The forwardmost end of the forward end of elongate strap 22 is denoted 42 in FIG. 5; it is formed into a loop or pocket and sewn as depicted. Fiberglass rod 43 is received within the hollow cavity defined by said loop, said rod having an extent that is slightly less than the transverse extent of loop 42.

A hemmed edge is provided on the opposite ends of loop or pocket 42. These hemmed edges prevent facile removal of rod 43 from pocket 42. Rod 43 is made of fiberglass so that it can flex and return to its original shape without permanent distortion in the event a user sits or stands on it or otherwise intentionally or unintentionally applies a bending force to it.

Two forward tensioning belts 44*a*, 44*b* are transversely spaced apart with respect to one another as depicted. A first end of each tensioning belt 44*a*, 44*b* is sewn or otherwise secured to the forward end of elongate strap 22, on the underside thereof, as at 46*a*, 46*b*.

As best understood from the left side of FIG. 5, which depicts tensioning belt 44*b* before it is tightened, the free end of tensioning belt 44*b*, i.e., the end that is not sewn at 46*b*, is passed over a transversely disposed cylindrical bar, not shown, that forms a part of base 48*a* of buckle 48.

More particularly, base 48*b* defines a frame having upstanding sidewalls, said sidewalls sharing the same reference numeral with frame 48*b*. An opening is formed in the floor of the base and that opening is spanned by the transversely disposed bar, leaving a tensioning belt-receiving opening on both the forward and rearward sides of the bar.

The free end of tensioning belt 44*b* travels upwardly through the forward opening, over the bar, and then downwardly through the rearward opening. The part of tensioning belt 44*b* that lies over the bar is denoted 47 on the left side of FIG. 5, i.e., if the lead line associated with reference numeral 47 were provided in dotted lines, then said reference numeral would indicate the bar.

Tensioning belt 44*b* is sewn to elongate strap 22 a second time as at 50*a* and said stitch 50*a* extends through elongate strap 22 so that said tensioning belt 44*b* tightly overlies loop 42 which houses fiberglass rod 43.

Base 48*a* of buckle 48 is thus captured by tensioning belt 44*b* between sewing lines 46*b*, 50*b*. The section of tensioning belt 44*b* between stitches 46*b*, 50*b* is also secured against movement.

The remaining extent of each tensioning belt 44*a*, 44*b* is about a foot in length or so, i.e., much longer than the extent thereof that is secured to the underside of elongate strap 22 in the manner just disclosed.

The distal free end of each tensioning belt 44*a*, 44*b* is denoted 52*a*, 52*b* and is fed through conventional releasable buckles 48, 48, each of which includes base 48*a*, 48*b* and hingedly mounted handle 54*a*, 54*b*. The left side of FIG. 5 depicts distal free end 52*b* before it is pulled tightly around forwardmost transversely disposed part of frame 14*b*. Handle 54*b* is therefore in its open position as depicted.

The right side of FIG. 5 depicts the distal free end of tensioning belt 44*a* tightly engaged to said forwardmost transversely disposed part 14*b*. Handle 54*a* is closed and locked. When tensioning belt 44*b* on the left side of FIG. 5 is similarly pulled taut over part 14*b*, elongate strap 22 will be taut from the head end of the chair to the foot end. Advantageously, as said elongate strap sags over time, it is a simple matter to lift buckle handles 54*a*, 54*b*, so that they are open as depicted on the left side of said FIG. 5, pull on the distal free ends 52*a*, 52*b* of tensioning belts 44*a*, 44*b* until elongate strap 22 is again taut, and close buckle handles 54*a*, 54*b*, i.e., return them to their right side of FIG. 5 position.

Rod 43 distributes the user's weight across the entire surface of elongate strap 22 so that said weight is not concentrated on the two points of connection for tensioning belts 44*a*, 44*b* and buckles 48, 48. In the absence of rod 43, the stresses on elongate strap 22 under heavy load would cause elongate strap 22 to tear, deform, cause extreme wrinkling and lead to total failure of elongate strap 22 when placed under heavy load. Tensioning belts 44*a*, 44*b* pull against rod 43 and not the fabric of which elongate strap 22 is made.

Figure 6:
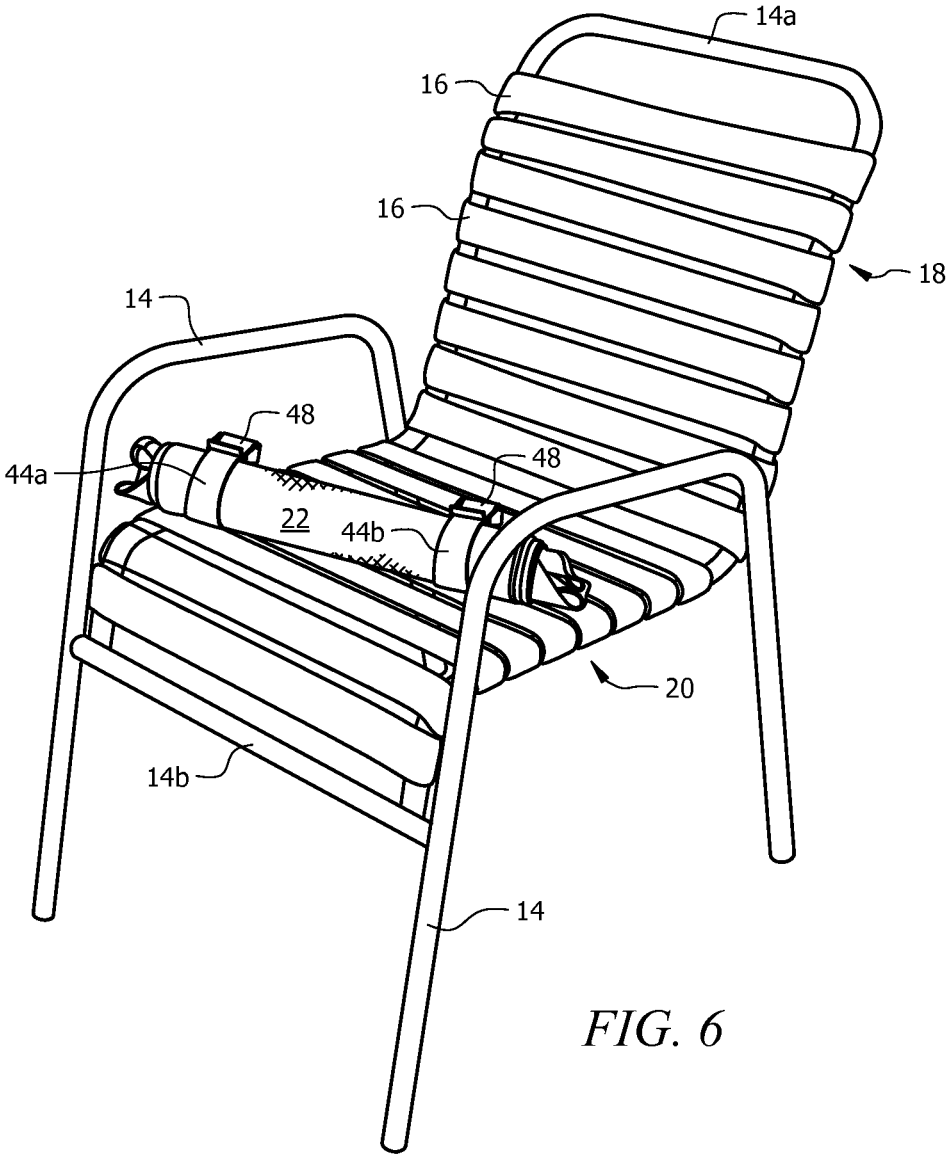
FIG. 6 is a perspective view depicting the novel structure in its rolled, storage configuration.

FIG. 6 indicates that elongate strap 22 may be rolled up and secured against unrolling when not in use.

The novel structure works in an integral, structural and co-dependent manner with strap furniture. Elongate strap 22 is attached to the structural frame of the furniture and supports the load of a user independently of the transverse straps but the transverse straps are important to the overall function of the invention.

The transverse straps act as a cushioning means. Elongate strap 22 is capable of being tightened to such an extent that transverse straps 16 provide only nominal support because most of the user's weight is transferred from the transverse straps to the frame. However, as tension is released from elongate strap 22, transverse straps 16 increasingly support more of the user's weight. The transverse straps are generally made of vinyl so their elasticity provides a more cushioned effect for the user.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An elongate strap-tightening structure for a furniture item such as a chair or chaise lounge having a frame that supports an elongate strap that extends the longitudinal extent of the furniture, said elongate strap being subject to sagging over time and said elongate strap being an integral part of the furniture item, comprising:

a plurality of transversely disposed straps supported by said frame;

said plurality of transversely disposed straps extending from a rearward, back rest section of said furniture to a forward, seat or foot section of said furniture;

said elongate strap including a back section that overlies most of the transversely disposed straps at the rearward section of said furniture and a forward section that overlies most of the transversely disposed straps at the forward section of said furniture;

at least one of said transversely disposed straps disposed in overlying relation to said elongate strap at the rearward section and at least one of said transversely disposed straps disposed in overlying relation to said elongate strap at the forward section:

a rearward end of said elongate strap disposed in overlying relation to a transversely disposed rearward end of said frame;

a fastening means that secures said rearward end of said elongate strap against longitudinal displacement when said forward end of said elongate strap is pulled taut at the forward section of said furniture;

a pair of laterally spaced apart, longitudinally extending tensioning belts secured to a forward end of said elongate strap;

a pair of releasable buckles secured to a bottom side of said elongate strap near the forward end of said elongate strap;

a distal free end of each of said tensioning belts wrapping around said transversely disposed forward end of said frame and being adjustably engaged to respective buckles of said pair of releasable buckles;

whereby said releasable buckles are opened to enable said tensioning belts and hence said elongate strap to be pulled taut; and whereby said releasable buckles are closed when said elongate strap is pulled taut.

2. The strap-tightening structure of claim 1, further comprising:

said forward end of said elongate strap having a loop formed therein;

a rod disposed within an interior space defined by said loop;

a first end of each tensioning belt being secured to said forward end of said elongate strap on an underside of said elongate strap in longitudinally spaced apart relation to said loop.

3. The strap-tightening structure of claim 2, further comprising:

each of said releasable buckles including a base and a hingedly mounted handle;

said base of each releasable buckle including a transversely disposed bar that spans an opening formed in said base, there being a tensioning belt-receiving space forward and rearward of said bar;

said distal free end of each tensioning belt extending upwardly through the forward strap-receiving space, over the bar, and downwardly through the rearward strap-receiving space;

each tensioning belt extending downwardly through said rearward strap-receiving space being wrapped around said loop and secured in tightly overlying relation to said loop, thereby securing said bar and said base of each releasable buckle to said underside of said elongate strap;

whereby a distal free end of each elongate strap is adjustably engageable to said respective buckles of said pair of releasable buckles.

4. The strap-tightening structure of claim 3, further comprising:

said rearward section of said elongate strap having a width greater than a width of said forward section.

5. The strap-tightening structure of claim 4, further comprising:

said rearward section of said elongate strap being sculpted at its upper left and right corners so that upper left and right corners of said frame are not covered by said elongate strap.

6. The strap-tightening structure of claim 5, further comprising:

a lower part of said rearward section of said elongate strap being sculpted so that it shares a common width with that of said forward section.

7. The strap-tightening structure of claim 6, further comprising:

a medial region of said rearward section of said elongate strap having a greater width than the sculpted section at said upper left and right corners and the sculpted section at said lower part of said rearward section of said elongate strap.

8. The strap-tightening structure of claim 7, further comprising:

a transversely disposed pocket formed in a free end of said rearward end of said elongate strap;

a fastening belt slidingly received within said pocket, said fastening belt formed integrally with the medial region of said elongate strap and holding said medial region and hence said elongate strap against longitudinal movement.

9. The strap-tightening structure of claim 8, further comprising:

said medial region of said elongate strap disposed in wrapping relation to longitudinally disposed sections of said frame that form said rearward section;

each opposite end of said medial region having a loop formed therein;

an outboard end of a metal loop captured by each or said medial region loops;

an inboard end of each metal loop capturing one of said fastening belts;

each of said fastening belts having mating quick release fasteners secured to a free end thereof so that the effective length of each fastening belt is adjustable;

whereby when said fastening belt is taut, the rearward end of said elongate strap is also taut relative to said rearward section of the chair; and whereby said elongate strap is taut when the rearward and forward ends of said elongate strap are taut.

10. The strap-tightening structure of claim 1, further comprising:

said at least one of said transversely disposed straps disposed in overlying relation to said elongate strap at the rearward section including a first transversely disposed strap disposed near a forward end of said rearward section; and said at least one of said transversely disposed straps disposed in overlying relation to said elongate strap at the forward section including a first transversely disposed strap disposed near a forward end of said forward section.

* * * * *